US009854924B2

(12) United States Patent
Klermund

(10) Patent No.: US 9,854,924 B2
(45) Date of Patent: Jan. 2, 2018

(54) OUTFIT HANGER AND DISPLAYER

(71) Applicant: Tomorrow's Outfit, LLC, Madison, WI (US)

(72) Inventor: Barbara Klermund, Madison, WI (US)

(73) Assignee: TOMORROW'S OUTFIT, LLC, Madison, WI (US)

( * ) Notice: Subject to any disclaimer, the term of this patent is extended or adjusted under 35 U.S.C. 154(b) by 0 days.

(21) Appl. No.: 15/012,053

(22) Filed: Feb. 1, 2016

(65) Prior Publication Data

US 2016/0220044 A1 Aug. 4, 2016

Related U.S. Application Data

(60) Provisional application No. 62/111,003, filed on Feb. 2, 2015.

(51) Int. Cl.

| | |
|---|---|
| ***A47F 8/02*** | (2006.01) |
| ***A47G 25/16*** | (2006.01) |
| ***A47G 25/24*** | (2006.01) |
| ***A47G 25/06*** | (2006.01) |

(52) U.S. Cl.

CPC ..... *A47F 8/02* (2013.01); *A47G 25/0607* (2013.01); *A47G 25/0614* (2013.01); *A47G 25/16* (2013.01); *A47G 25/24* (2013.01)

(58) Field of Classification Search

CPC ..... A47F 7/00; A47F 8/00; A47F 8/02; A47G 25/0607; A47G 25/0614; A47G 25/16; A47G 25/02; A47G 25/04; A47G 25/20; A47G 25/24; A47G 25/28; A47G 25/34; A47G 25/36; A47G 2025/1485

USPC ..... D6/315, 316, 317; D20/25, 31, 32

See application file for complete search history.

(56) References Cited

U.S. PATENT DOCUMENTS

| | | | | |
|---|---|---|---|---|
| 5,022,569 | A * | 6/1991 | Beaulieu | A47F 8/02 223/85 |
| 5,842,562 | A * | 12/1998 | Bauman | A63H 3/005 206/566 |
| 6,161,686 | A * | 12/2000 | Simon | A45C 11/16 206/6.1 |
| 6,170,721 | B1 * | 1/2001 | Chen | A47G 25/0671 223/85 |
| 7,077,301 | B2 * | 7/2006 | Dudley | A47F 8/00 223/120 |
| 2013/0238285 | A1 * | 9/2013 | Volchek | A41H 5/01 702/188 |

* cited by examiner

*Primary Examiner* — Ismael Izaguirre
(74) *Attorney, Agent, or Firm* — Corridor Law Group, P.C.

(57) ABSTRACT

An outfit hanger and displayer has a head section, a shoulder section, a torso section, a bottom (hip/waist) section, a neck section, an arm section, and a hand section. In some embodiments the head section has a loop, a hanging hook and an earring section. The earring section can be made of, among other things, a polystyrene foam, a magnetic material, a plastic material, or an adhesive material. In some embodiments the torso section is expandable. In some embodiments the hanger has a necklace/scarf guide that can be used to display necklaces or scarves on the hanger. In some embodiments, the outfit hanger has at least one stabilizing foot.

20 Claims, 7 Drawing Sheets

New Sheet

OUTFIT HANGER AND DISPLAYER

CROSS-REFERENCE TO RELATED APPLICATIONS

This application is related to and claims priority from U.S. Provisional Application No. 62/111,003 filed Feb. 2, 2015 entitled "Outfit Hanger and Displayer". The '003 application is hereby incorporated by reference in its entirety.

FIELD OF THE INVENTION

The present invention relates to clothes hangers and displayers. More specifically, the invention relates to an outfit hanger that can be used to display multiple parts of an outfit (tops, bottoms, and accessories).

BACKGROUND OF THE INVENTION

Many individuals use hangers to store their clothes. Hanging clothes helps prevent the clothes from wrinkling and/or being damaged. Hanging clothes is often preferred over putting clothes in dressers and/or trunks since clothes that are hung, tend to be easier to access and also tend to have less wrinkles than clothes placed in dressers.

Traditional hangers are limited in that they can only hold and/or display one or two pieces of clothing. In addition, traditional hangers do not have a way to display and/or store various accessories such as, but not limited to, jewelry (including but not limited to, rings, necklaces, watches, bracelets, and earrings), headpieces, hats, caps, headbands, hair ties, scrunchies, sunglasses, scarves and/or purses. Thus, it is often hard for individuals to envision what a complete outfit will look like without putting on all of its pieces. Trying on an entire outfit can be time consuming and using a traditional mannequin is often just as time consuming. Furthermore, many individuals do not have space to store a traditional mannequin. What is needed is a device that allows a user to pick out an entire outfit, including various accessories, and see how the entire outfit looks when it is put together without trying it on, yet is small enough to be used in most households.

SUMMARY OF THE INVENTION

An outfit displayer can include a head section, a shoulder section, a torso section; a bottom (hip/waist) section; an arm section, a neck section, and at least one stabilizing foot. The outfit displayer can also include necklace guide. In some embodiments the necklace guide is movable.

The head section of the outfit displayer can include a loop, a hanging hook and/or an earring section. The earring section can be made of a variety of materials including, polystyrene foam, and magnetic materials and/or include a hole configured to hold an earring. In some embodiments the loop is configured to be moveable between an open position and a closed position In some embodiments the arm section can be attached to an arm extension and/or a hand section. The arm section can be connected to the arm extension via an arm connector.

In certain embodiments the torso section can include a first torso section; and a second torso section, wherein the second torso section fits into the first torso section such that said torso section is expandable.

BRIEF DESCRIPTION OF THE DRAWINGS

FIG. 6B is a closeup-front view of a head section showing the loop in a closed position.

DETAILED DESCRIPTION OF PREFERRED EMBODIMENT(S)

Figure 1:
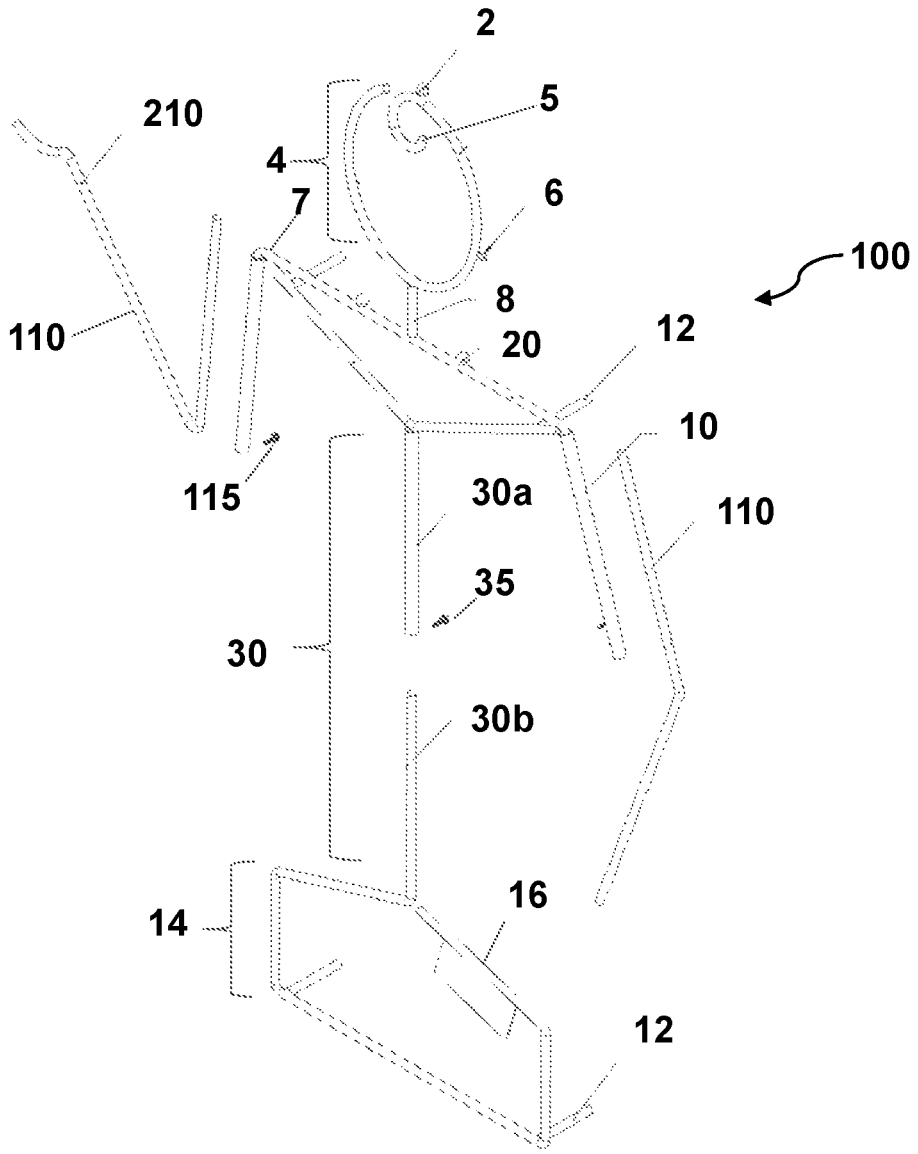
FIG. 1 is an exploded perspective view of an outfit hanger and displayer.

FIG. 1 illustrates an exploded perspective view of outfit hanger and displayer 100. A user can place various garments and/or accessories on hanger 100 to display a particular outfit. In some embodiments, clothes pins or clips are used to hang the garments on hanger 100.

Hanger 100 includes, among other things, head section 4, neck section 8, shoulder section 7, torso section 30, bottom (hip/waist) section 14, and arm section 10.

Head section 4 can include, among other things, loop 5, hanging hook 2, and earring section 6.

Figure 4:
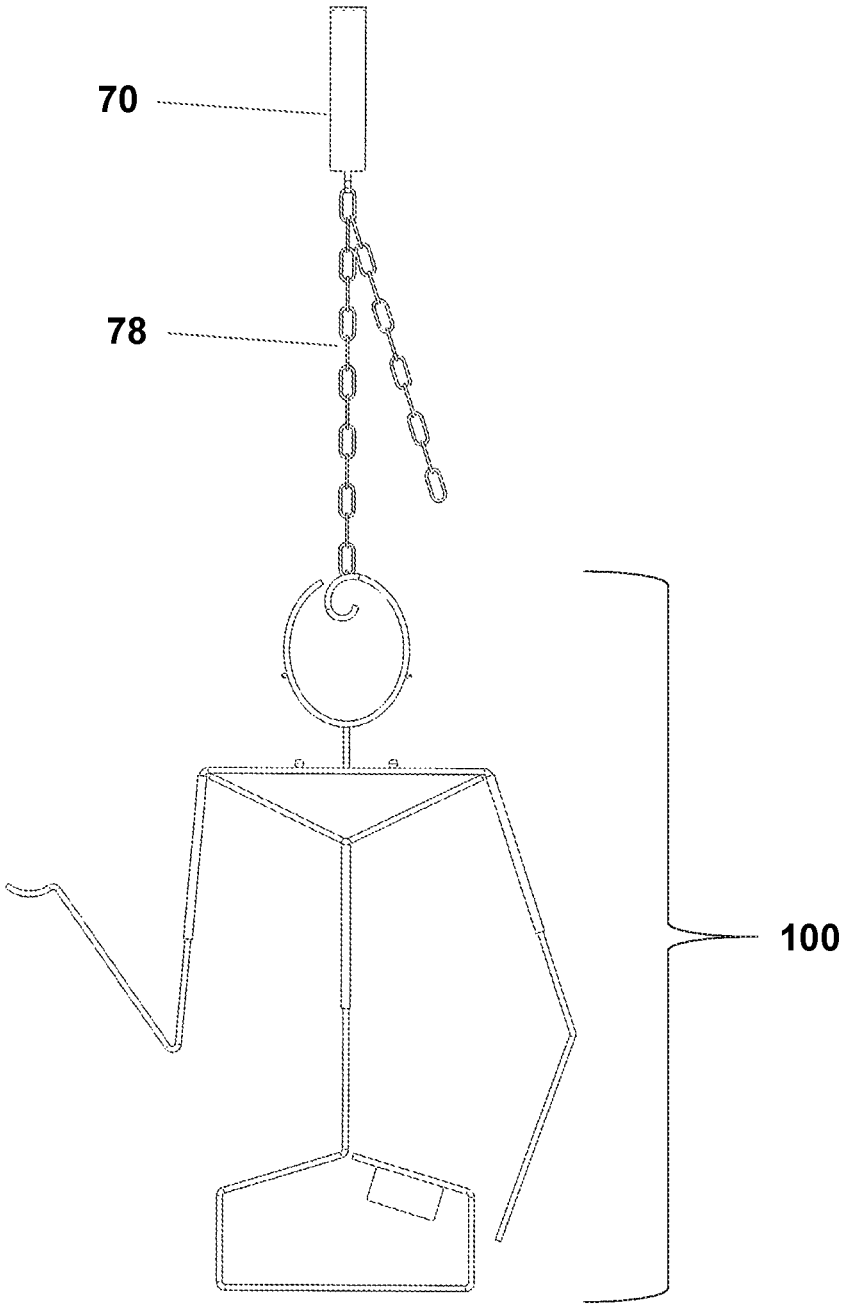
FIG. 4 is a front view of an outfit hanger and displayer hanging from a hook.

In some embodiments hanging hook 2 is configured to hang from chain 78 or S-hooks (see FIG. 4) in conjunction with anchor hanger 70 (see FIG. 4). Chain 78 or S-hooks can be used to allow hanger 100 to grow with the user. In other embodiments, hanging hook 2 can be used to position hanger 100 directly on a wall. In some embodiments, hanging hook 2 can be a clasp, loop or ring.

Earring section 6 is configured to display and/or store earrings. In some embodiments earring section 6 is made of a material such as polystyrene foam or fabric that can be pierced by earrings. In other or the same embodiments, earring section is made of a magnetic material or contains a section of a magnetic material so that it will hold magnetic earrings. In other embodiments, earring section 6 has holes in head section 4 wherein the holes are configured for receiving earrings. In other or the same embodiments, earring section is made of an adhesive material or contains a section of adhesive material configured to hold the earrings.

Loop 5 is configured to display and/or store, among other things, various types of headpieces, hats, headbands, caps and/or helmets. In some embodiments loop 5 is configured to have an open and closed position. When loop 5 is in the open position, it can receive various headpieces, hats, headbands, and the like. Loop 5 can then be placed in a closed position so that the various headpieces, hats, headbands, and the like do not fall off if hanger 100 is moved. In other or the same embodiments loop 5 can also be in a semi-closed position.

Figure 6A:
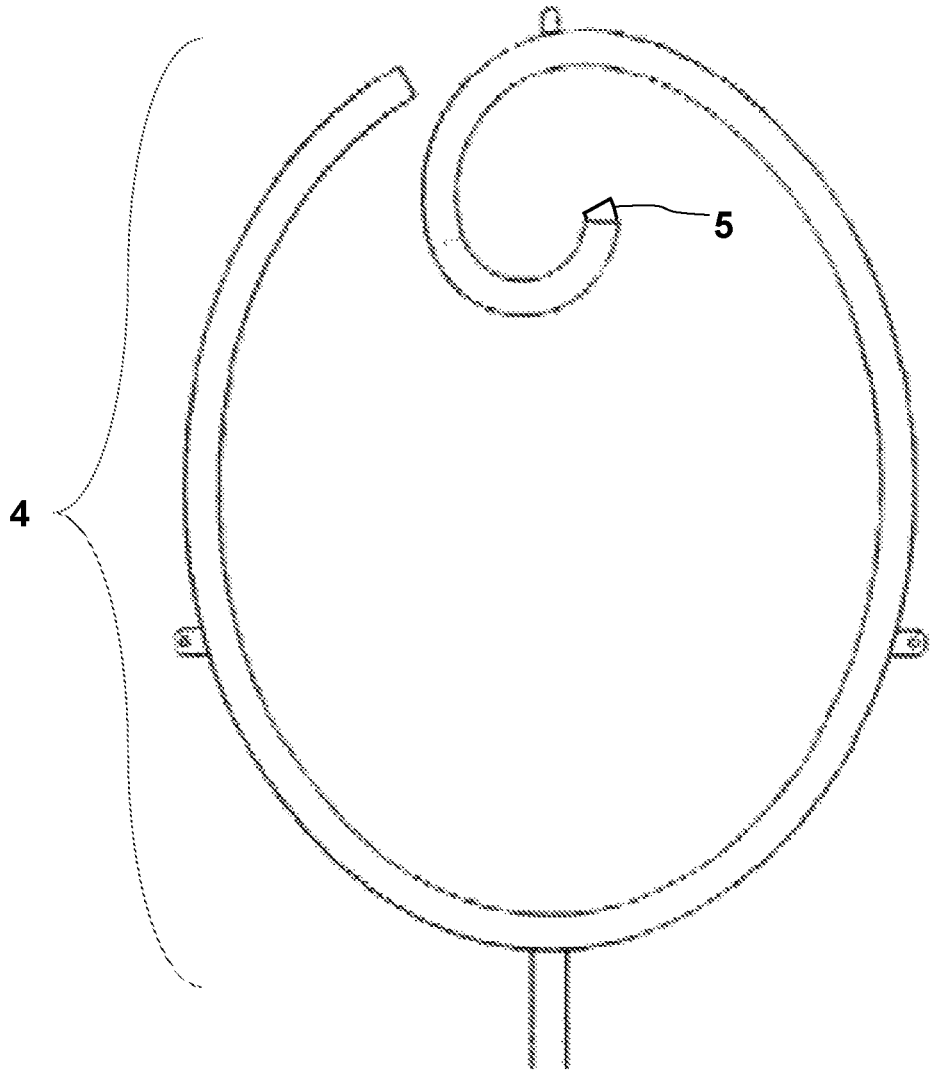
FIG. 6A is a closeup-front view of a head section showing the loop in an open position.
Figure 6B:
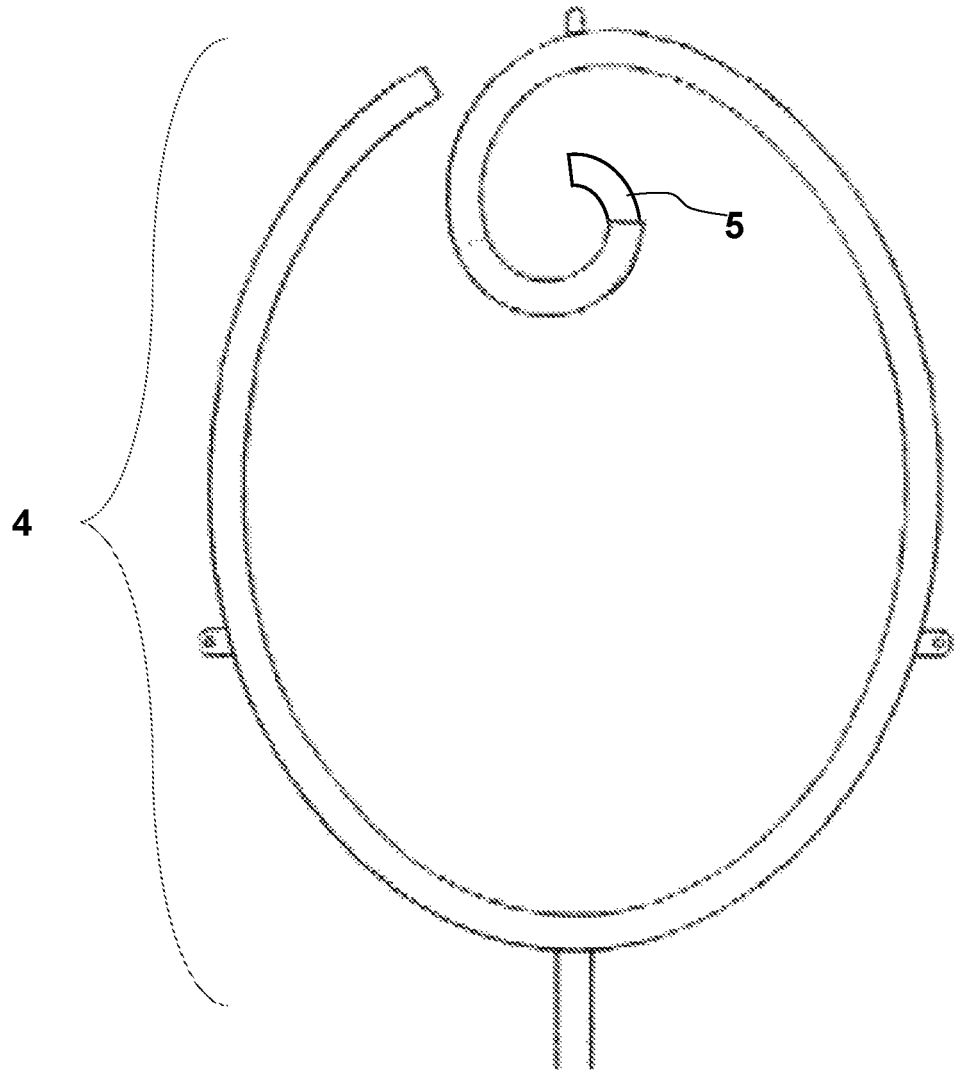
FIG. 6B is a closeup-front view of a head section showing the loop in a semi-closed position.
Figure 6C:
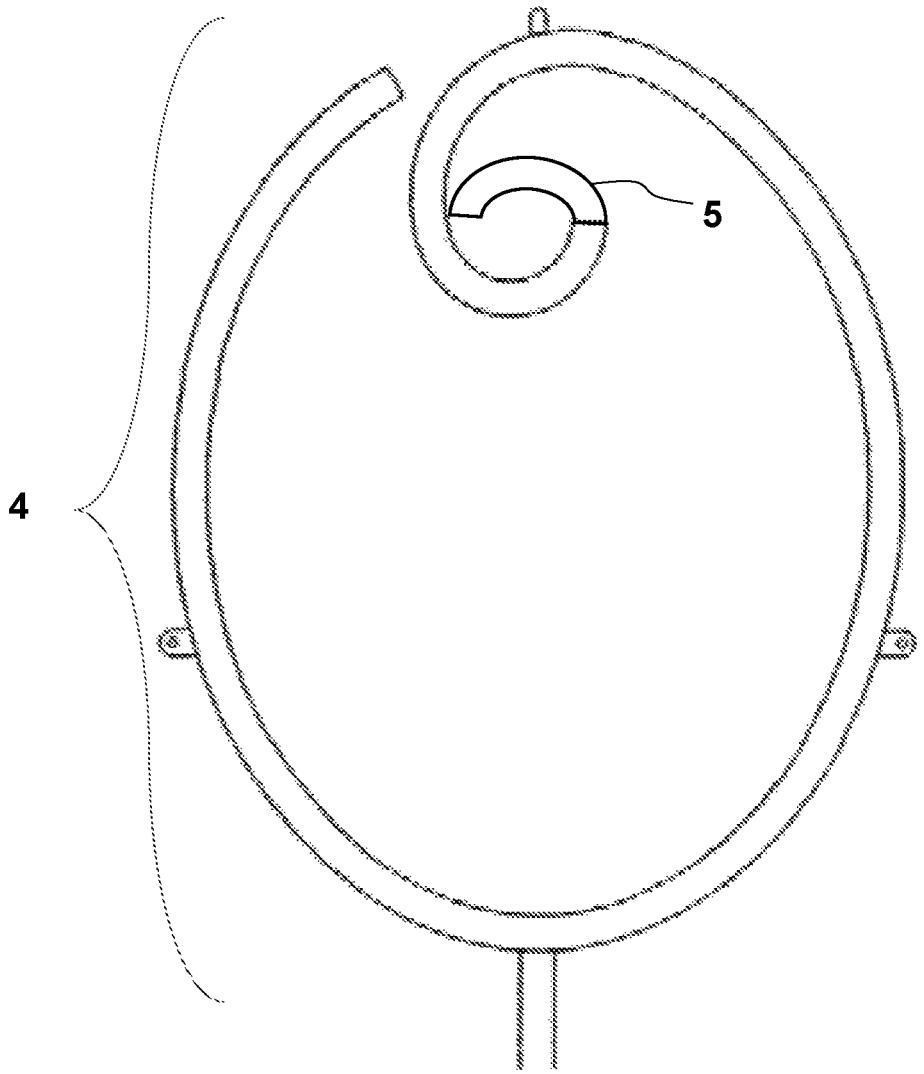

FIGS. 6A-6C illustrate a closeup view of head section 4 in which loop 5 is in various stages of being open. FIG. 6A shows the loop in an open position. FIG. 6B shows the loop in a semi-closed position. FIG. 6C shows the loop in a closed position.

Hanger 100 can also include necklace/scarf guides 20 which are configured to store and/or display necklaces or scarves. Necklace/scarf guides 20 are placed on hanger 100 so that when a necklace or scarf is placed on necklace/scarf guides 20 it hangs on hanger 100 roughly where it traditionally would when being worn by the individual. In some embodiments necklace/scarf guides 20 are able to be moved to various positions to change the way the necklace/scarf drapes on hanger 100.

Shoulder section 7 is configured to display and/or store various types of outfit tops, including, but not limited to, shirts, tank tops, camis, cardigans, hoodies, sweatshirts, sweaters, strapless tops, dresses, undergarments, and layering of any of the above.

Turning to arm section 10, in some embodiments arm section 10 can be extended via arm extension 110. In some embodiments arm section 10 and arm extension 110 are attached to each other by arm connector 115. Arm connector 115 can be, among other things, a pin, a thumbscrew, a push button, or a magnet. In some embodiments arm section 10 is of a telescoping configuration to expand based on the size of the individual.

Hand section 210 can be configured to hold and/or display various accessories such as, but not limited to bracelets, watches, rings, purses and/or hanger with a matching outfit for a doll. In other or the same embodiments, hand section 210 can be attached to arm section 10 and/or arm extension 110. In some embodiments hand section 210 is connected to arm section 10 or arm extension 110 with a hand connector (not shown). Hand connector can be, among other things, a pin, a thumbscrew, a magnet, or push button.

Torso section 30 can be configured to expand in size based on the size of the user. In some embodiments, torso section 30 is made up of first torso part 30*a* and second torso part 30*b*. In some embodiments first torso part 30*a* is connected to second torso part 30*b* with torso connector 35. Torso connector 35 can be, among other things, a pin, a thumbscrew, a magnet, or a push button. In other or the same embodiments torso section 30 can be made a single section that is telescoping in nature.

Bottom section 14 is configured to receive various types of outfit bottoms, including, but not limited to, pants, skirts, skorts, shorts, leggings, jeggings, capris, yoga pants, sweats, undergarments and/or layering of any of the above. In some embodiments, bottom section 14 includes logo plate 16. Logo plate can be used to display, among other thing, the individual user's name.

In some embodiments, hanger 100 includes stabilizing feet 12. Stabilizing feet 12 aid in keeping hanger 100 from marking up walls/doors, and/or falling forward when the various garments and accessories are held/displayed on it. In some embodiments, stabilizing feet can be capped with rubber or polystyrene foam.

Figure 2:
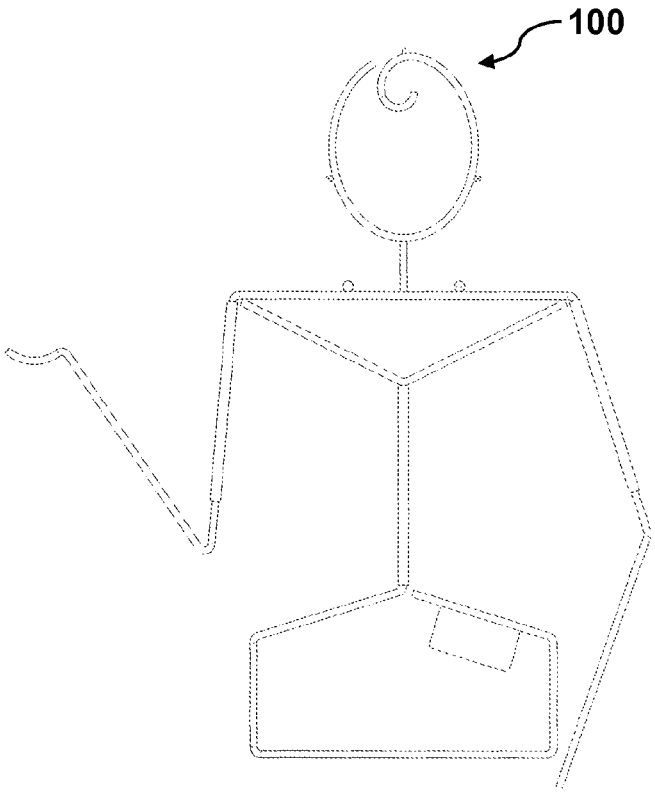
FIG. 2 is a front view of an outfit hanger and displayer.
Figure 3:
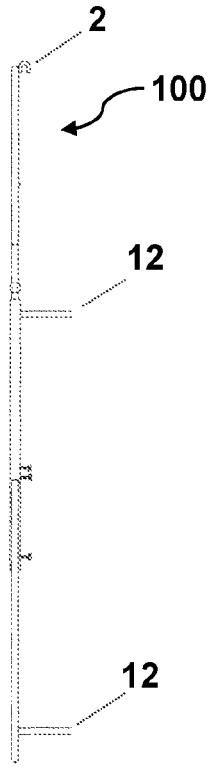
FIG. 3 is a side view of an outfit hanger and displayer.

FIG. 2 is a front view of hanger 100. While FIG. 3 shows a side view of hanger 100 illustrated in FIG. 2. Stabilizing feet 12 and hanging hook 2, as described above, are prominent in FIG. 3.

Turning to FIG. 4, hanger 100 is shown hanging from anchor hanger 70 via chain 78 or S-hooks. Various embodiments of anchor hanger 70 are illustrated in FIG. 5*a* and FIG. 5*b*.

Figure 5A:
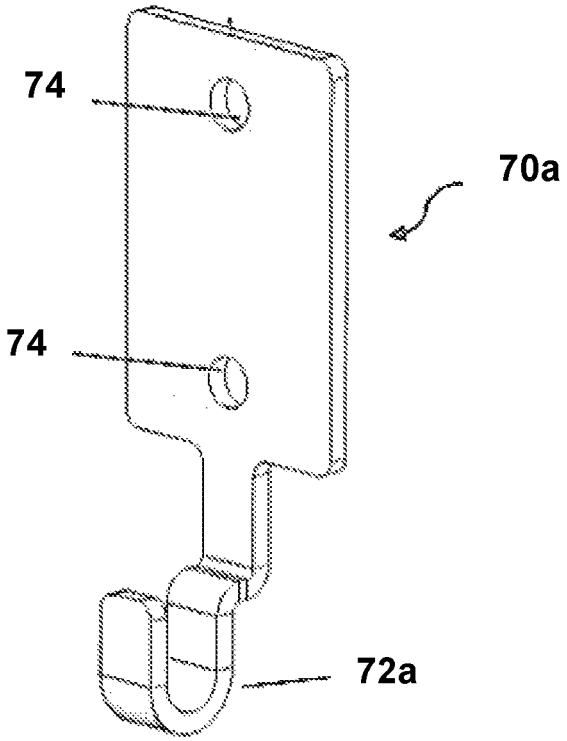
FIG. 5*a* is a perspective view of one embodiment of a hook configured to hang an outfit hanger and displayer.
Figure 5B:
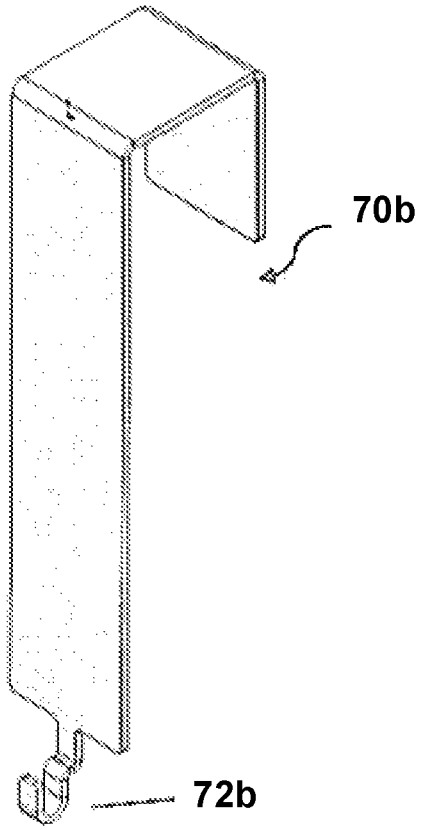
FIG. 5*b* is a perspective view of another embodiment of a hook configured to hang an outfit hanger and displayer.

FIG. 5*a* illustrates anchor hanger 70*a* configured to be hung on a wall. In the embodiment illustrated in FIG. 5*a* screws and/or nails can be used in conjunction with holes 74 to place anchor hanger 70*a* on, among other things, a wall, post, and/or a piece of furniture. Anchor hanger hook 72*a* can be configured to hold hanger 100 via chain 78, S-hooks, or hanging hook 2. In some embodiments, such as the one illustrated, anchor hanger hook 72*a* is turned out to prevent, or at least reduce, chain 78, S-hooks, and/or hanger 100 from hitting the door and/or wall.

FIG. 5*a* illustrates anchor hanger 70*b* configured to be hung over a door. Anchor hanger hook 72*b* can be configured to hold hanger 100 via chain 78, S-hooks, or hanging hook 2. In some embodiments, such as the one illustrated, anchor hanger hook 72*b* is turned out to prevent, or at least reduce, chain 78, S-hooks, and/or hanger 100 from hitting the door and/or wall.

Hanger 100 can be made of a variety of materials including, but not limited to, metals, plastics, wood, PVC, paper, fabric, fiberglass, cardboard, and composite material.

While particular elements, embodiments and applications of the present invention have been shown and described, it will be understood, that the invention is not limited thereto since modifications can be made without departing from the scope of the present disclosure, particularly in light of the foregoing teachings.

What is claimed is:

1. An outfit displayer comprising:
a) a head section comprising
i) a loop wherein said loop is configured to be moveable between an open position and a closed position;
ii) a hanging hook; and
iii) an earring section;
b) a torso section;
c) a bottom section; and
d) an arm section.

2. The outfit displayer of claim 1 further comprising:
e) a neck section.

3. The outfit displayer of claim 1 further comprising a necklace guide.

4. The outfit displayer of claim 1 wherein said arm section is configured to be attached to an arm extension.

5. The outfit displayer of claim 1 wherein said arm section is configured to be attached to a hand section.

6. The outfit displayer of claim 4 wherein said arm section and said arm extension are connected via an arm connector.

7. The outfit displayer of claim 1 further comprising a stabilizing foot.

8. The outfit displayer of claim 7 wherein said stabilizing foot is located on said bottom section.

9. The outfit displayer of claim 1 wherein said loop is configured to hold a headpiece.

10. An outfit displayer comprising:
a) a head section;
b) a torso section comprising
i) a first torso section; and
ii) a second torso section, wherein said second torso section fits into said first torso section such that said torso section is expandable;
c) a bottom section;
d) an arm section; and
e) a hanging hook configured to hang the outfit displayer.

11. The outfit displayer of claim 10 further comprising:
f) a neck section.

12. The outfit displayer of claim 10 further comprising a necklace guide.

13. The outfit displayer of claim 10 wherein said arm section is configured to be attached to an arm extension.

14. The outfit displayer of claim 10 wherein said arm section is configured to be attached to a hand section.

15. An outfit displayer comprising:
a) a head section;
b) a torso section;
c) a bottom section;
d) an arm section; and
e) a stabilizing foot located on a shoulder section.

16. The outfit displayer of claim 15 further comprising:

e) a neck section.

17. The outfit displayer of claim 15 further comprising a necklace guide.

18. The outfit displayer of claim 15 wherein said arm section is configured to be attached to an arm extension.

19. The outfit displayer of claim 15 wherein said arm section is configured to be attached to a hand section.

20. The outfit displayer of claim 15 further comprising a second stabilizing foot, wherein said second stabilizing foot is located on said bottom section.

* * * * *